United States Patent [19]

Vertegaal

[11] 4,117,779

[45] Oct. 3, 1978

[54] MEANS TO PROVIDE UNIFORM LENGTHWISE SQUEEGEE ANGLE OF ATTACK

[75] Inventor: Jacobus Gerardus Vertegaal, Boxmeer, Netherlands

[73] Assignee: Stork Brabant B.V., Boxmeer, Netherlands

[21] Appl. No.: 719,240

[22] Filed: Aug. 31, 1976

[30] Foreign Application Priority Data

Sep. 3, 1975 [NL] Netherlands ..... 7510421

[51] Int. Cl.[2] ..... B41F 15/38; B41F 15/44

[52] U.S. Cl. ..... 101/120; 101/127.1

[58] Field of Search ..... 101/119, 120, 123, 124, 101/157, 169, 127.1, 128.1

[56] References Cited

U.S. PATENT DOCUMENTS

| | | | |
|---|---|---|---|
| 2,974,586 | 3/1961 | Hunt | 101/157 |
| 3,398,680 | 8/1968 | Moskowitz | 101/120 X |
| 3,858,507 | 1/1975 | Owren et al. | 101/128.1 X |
| 3,934,502 | 1/1976 | Marino | 101/119 X |
| 3,942,438 | 3/1976 | Zimmer | 101/120 |

FOREIGN PATENT DOCUMENTS

| | | | |
|---|---|---|---|
| 288,446 | 3/1971 | Austria | 101/128.1 |
| 2,302,728 | 7/1974 | Fed. Rep. of Germany | 101/120 |
| 480,949 | 12/1969 | Switzerland | 101/120 |

*Primary Examiner*—Ronald E. Suter
*Attorney, Agent, or Firm*—Edmund M. Jaskiewicz

[57] ABSTRACT

A rotary screen printing machine comprising a plurality of rotatably mounted cylindrical screen stencils each having an internal squeegee blade supported in a holder, means being provided either in the mounting of the stencil or in the support of the squeegee blade for obtaining a uniform angle between said blade and the stencil along the entire length of said stencil.

5 Claims, 6 Drawing Figures

Fig: 1.
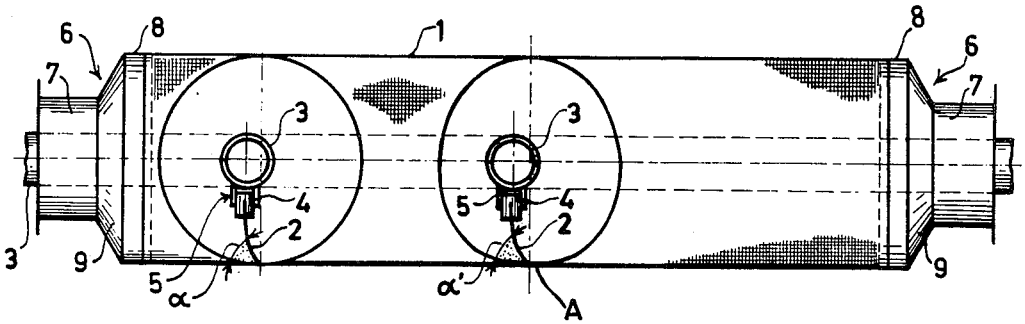
Fig: 2A.
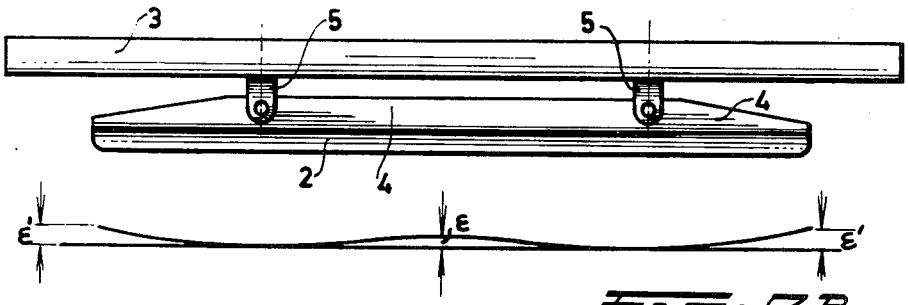
Fig: 2B.
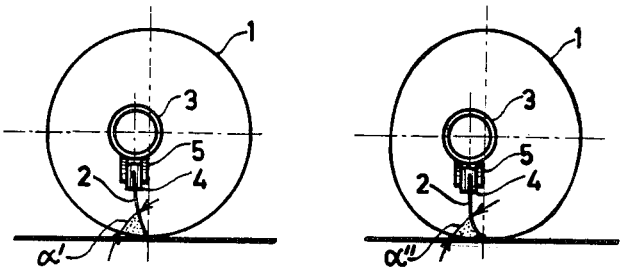
Fig: 2C.

MEANS TO PROVIDE UNIFORM LENGTHWISE SQUEEGEE ANGLE OF ATTACK

BACKGROUND OF THE INVENTION

The invention relates to a rotary screen printing machine, comprising a frame with at least one cylindrical thinwalled stencil rotatably supported therein, the stencil being provided with an inner squeegee blade supported by an adjustable support. Such a machine, intended for printing upon a textile web or a paper strip, is known from U.S. Pat. Nos. 3,892,176; 3,675,571; 3,718,086; 3,420,167; 3,304,860 and in particular No. 3,933,093.

When these printing machines are in use, there occur circumstances under which the quantity of dye is nonuniformly applied upon the web or strip as considered over the entire length of each stencil. Sometimes, a greater quantity of dye is supplied in the proximity of the ends of the stencil (that is to say in the proximity of the sides of the web to be printed) as compared with the central area of the stencil. This symptom also called "side smearing" is probably a result of the squeegee angle being smaller near the ends of the stencil, than in the central area thereof. In the central area of each stencil the cylindrical shape is somewhat flattened so that the squeegee angle in this central area is greater than in the vicinity of the ends. Since the quantity of dye applied is in inverse ratio to the squeegee angle, more dye will be applied to the sides of the web to be printed than to its central area.

DISCUSSION OF THE PRIOR ART

Efforts have been made already to decrease the flattening occurring in each stencil during the printing process. One such effort was tensioning the stencils in the axial direction (see U.S. Pat. No. 3,933,093). However in practice, it appears that a small flattening was inevitable, with the result that the desired uniformity in the quantity of dye applied was not obtained. The invention seeks to improve the screen printing machine in this respect and for that purpose the present machine is provided with a suitable structure for adapting the squeegee angle near the ends of each stencil to the real squeegee angle in the central region of the respective stencil.

As a result, an increase of the squeegee angle at the ends of the squeegee is obtained up to a value of the squeegee angle in the region where the deformation of the stencil is the greatest. Such an adaptation can be carried out in various ways.

SUMMARY OF THE INVENTION

When the starting point is a screen printing machine known from U.S. Pat. No. 3,933,093, wherein each squeegee is mounted in a holder connected to the support, there may be provided an increase in flexibility of the squeegee holder near the squeegee ends. Due to this greater flexibility, the squeegee on being pressed against the inner wall of the stencil will assume a steeper position towards its ends. As a consequence, the squeegee angle near the ends of the stencil will increase, so that this angle thus corresponds to the angle in the central area of the stencil.

In another embodiment the starting point may be a screen printing machine in which each stencil is connected at its extremities to an annular mounting member. In such a machine known from the aforementioned literature, the inventive conception is realized by providing at least part of each mounting member on which an extremity of the stencil is fixed, a more flexible construction than the rest of the mounting member. Thus, the inevitable deformation of the stencil in the central area will likewise occur near the extremities of the stencil, so that the squeegee angle and therefore also the quantity of dye applied are equal over the entire length of the stencil. In other words, a certain flattening of the stencil occurs at the location of the annular mounting member, since the flexibility thereof is about identical to that of the stencil itself.

The invention in another aspect relates to a thinwalled cylindrical screen stencil with two end rings each having two cylindrical parts with a tapering intermediate portion, this intermediate portion and the greatest cylindrical part of each end ring consisting of rubber or a likewise resilient material.

The invention is moreover embodied in a squeegee support, which may comprise a supporting pipe with a holder connected therewith, in which a squeegee blade is mounted and which according to the invention has such a construction of the squeegee holder and/or its connection with the supporting pipe that in case of a uniform load applied to the squeegee blade the extremities of the holder deflect more than the cental area.

SURVEY OF THE DRAWINGS

FIG. 1 shows in elevation a stencil in operation in which are included two cross sections turned through 90°;

FIG. 2A–2C show a first embodiment of a squeegee support according to the invention;

DESCRIPTION OF PREFERRED EMBODIMENTS

Figure 3:
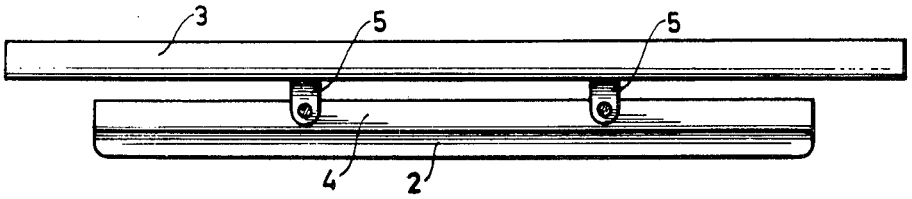
FIG. 3 shows in elevation a second embodiment of a squeegee support.

The general construction of the rotary screen printing machine according to the invention is in conformity with the aforementioned Patent Specifications. Such a machine consists of a frame with at least one, but preferably a plurality, e.g. 8, 12 or 15, cylindrical thinwalled stencils 1 which are rotatably supported therein. Each stencil has an inner squeegee 2 supported by an adjustable support 3 constructed as a pipe. Each squeegee blade 2 is mounted in a holder 4 which is connected at two points at 5 with the supporting pipe 3. In the printing process the squeegee has an angle $\alpha$ with respect to the wall of the stencil. The stencil 1 is provided with two end rings 6 each having two cylindrical parts 7 and 8 with a conical intermediate portion 9.

During operation a deformation will take place in the center of the stencil 1, the deformation being a flattened zone A in the area which contacts the material to be printed on one side and the squeegee on the other side. As a consequence the angle $\alpha'$ in the central part is greater than the angle near the ends where the cross-sectional shape of the stencil remains circular due to the influence of the annular mounting member 6. In FIG. 1 this stencil deformation is shown in a slightly exaggerated manner by means of two cross sections turned through 90°. As the quantity of dye applied is in inverse ratio to the squeegee angle $\alpha$, more dye is pressed through the pores near the extremities of the stencil 1

(where the angle $\alpha$ is smaller) on the material to be printed than in the central area. As a result the symptom of so-called side smearing will happen.

In FIG. 2A–2C a solution is offered for this unequal application of dye. For that purpose a provision is arranged for adapting the squeegee angle near the ends of each stencil to the real squeegee angle in the central region of the stencil concerned. This real angle $\alpha'$ is greater in the central part than corresponds with the inclination of the squeegee blade 2 owing to the local flattening in the area A of the stencil. The provision of FIG. 2A–2C consists of an increase of the flexibility of the squeegee holder 4 near the extremities of the squeegee blade 2. Hence the holder 4 will have a greater deflection at its ends than in the central area (see FIG. 2B). Consequently the spacing between holder 4 and the contact point of squeegee blade 2 with the inner wall of the stencil 1 will be slightly extended. This results in the squeegee blade 2 being slightly steeper at the ends than in its central area (see FIG. 2C), causing the squeegee angle $\alpha''$ to be substantially equal to squeegee angle $\alpha'$ in the central area.

The embodiment of FIG. 3, like in that of FIG. 2A–2C is based upon the structure known from U.S. Pat. No. 3,933,093. The spacing between the two connecting points 5 according to that Patent, was selected in such a manner that the deflection of holder 4 of the squeegee near the ends was substantially equal to the deflection in the central part of the holder. In FIG. 3 the two points 5 are closer to each other than according to the aforementioned Patent. Accordingly, in the situation of FIG. 2A–2C the deflection of the holder 4 will be greater near its ends than in the central area, whereby the compensation (that is to say increase) desired at of the squeegee angle near the extremities of the squeegee blade 2 is obtained. In this way the quantity of dye applied is kept as uniform as possible over the entire width of the web to be printed.

Figure 4:
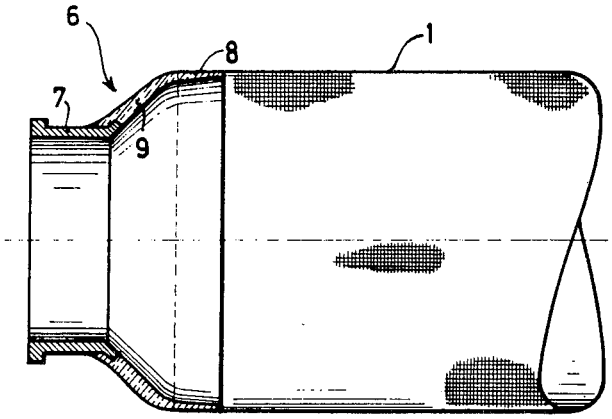
FIG. 4 shows in section one end of a thinwalled cylindrical screen stencil provided with a mounting element or end ring.

In the embodiment of FIG. 4 the increase of the squeegee angle desired at near its extremities, that is to say near the ends of the stencil 1, is obtained by a flexible construction of at least a part of each mounting member 6. The greater cylindrical part 8 and the intermediate tapering portion 9 are manufactured of rubber or a likewise resilient material.

The inventive concept underlying all aforementioned modifications of the invention is that the squeegee angle is increased near the ends of the squeegee, that is to say in such a way that this angle obtains a value $\alpha'$ which approximates the real squeegee angle $\alpha'$ in the central area of the stencil.

What I claim is:

1. In a rotary screen printing machine having a cylindrical stencil rotatably supported upon a frame and a squeegee device disposed within the cylindrical stencil, the squeegee device comprising a squeegee holder to which is attached a flexible squeegee blade such that a portion of the blade protrudes from the holder, the protruding portion of said blade having a trailing edge contacting the inner surface of said stencil in the region of the stencil contacting the material to be printed to define an angle with respect to the inner surface of the stencil, said squeegee device having ends and a central portion, and means on the printing machine acting upon said stencil for modifying the relative position of the inner surface of the stencil and trailing edge of the blade at the ends of the squeegee device to increase the angle at the ends of the squeegee device such that a uniform angle is obtained along the entire length of the blade.

2. In a rotary screen printing machine as claimed in claim 1 and said means comprising a pair of annular mounting members each having a portion upon which an end of the stencil is connected, said portion of each annular member being more flexible than the remaining portion of each such member whereby the squeegee angle near the ends of the stencil corresponds to the angle in the central portion of the stencil.

3. In a rotary screen printing machine as claimed in claim 2 wherein each of said annular mounting members comprises two axially spaced cylindrical portions and an intermediate tapering portion interconnecting said cylindrical portions, one cylindrical portion having a greater diameter than the other cylindrical portion and an end of said stencil being connected to said larger diameter cylindrical portion, the larger diameter cylindrical portion and said intermediate tapering portion being made of resilient material so as to have greater flexibility than the small cylindrical portion of each annular member.

4. In a rotary screen printing machine having a cylindrical stencil rotatably supported upon a frame and a squeegee device disposed within the cylindrical stencil, the squeegee device comprising a squeegee holder to which is attached a flexible squeegee blade such that a portion of the blade protrudes from the holder, the protruding portion of said blade having a trailing edge contacting the inner surface of said stencil in the region of the stencil contacting the material to be printed to define an angle with respect to the inner surface of the stencil, said squeegee device having ends and a central portion, and means for modifying the relative position of the inner surface of the stencil and trailing edge of the blade at the ends of the squeegee device to increase the angle at the ends of the squeegee device such that a uniform angle is obtained along the entire length of the blade, said means comprises said holder having greater flexibility at its ends such that when the squeegee holder is subjected to a uniform load from the squeegee device the ends of the holder will deflect more than the central portion thereof.

5. In a rotary screen printing machine as claimed in claim 4 wherein said squeegee device comprises an adjustable support and two connection points on said support to said holder, said connecting points being spaced closer together than corresponding to a spacing at which a deflection of the squeegee holder at its ends is equal to a deflection in the central portion thereof.

* * * * *